US005092590A

United States Patent [19]

Jones

[11] Patent Number: 5,092,590

[45] Date of Patent: Mar. 3, 1992

[54] METHOD FOR EXERCISING AND/OR TESTING MUSCLES OF THE LOWER TRUNK

[76] Inventor: Arthur A. Jones, 1155 NE. 77th St., Ocala, Fla. 32670

[21] Appl. No.: 637,618

[22] Filed: Jan. 4, 1991

Related U.S. Application Data

[60] Division of Ser. No. 422,905, Oct. 18, 1989, Pat. No. 5,005,830, which is a division of Ser. No. 236,367, Aug. 25, 1988, Pat. No. 4,902,009, which is a continuation-in-part of Ser. No. 60,679, Jan. 11, 1987, Pat. No. 4,836,536, which is a continuation-in-part of Ser. No. 181,372, Apr. 14, 1988, Pat. No. 4,834,365.

[51] Int. Cl.[5] ..... A63B 21/062

[52] U.S. Cl. ..... 272/118; 272/134; 73/379

[58] Field of Search ..... 272/117, 118, 128, 129, 272/130, 134, 143; 128/25 R; 73/379

[56] References Cited

U.S. PATENT DOCUMENTS

| | | | |
|---|---|---|---|
| 3,465,592 | 9/1969 | Perrino . | |
| 3,752,144 | 8/1973 | Weigle, Jr. . | |
| 4,104,918 | 8/1978 | Macoveanu et al. | 73/379 |
| 4,429,870 | 2/1984 | Gibbs | 272/117 |
| 4,431,184 | 2/1984 | Lew et al. | 272/118 X |
| 4,462,252 | 7/1984 | Smidt et al. . | |
| 4,500,089 | 2/1985 | Jones | 272/117 |
| 4,511,137 | 4/1985 | Jones | 272/118 |
| 4,538,805 | 9/1985 | Parviainen | 272/118 |
| 4,565,368 | 1/1986 | Boettcher | 272/129 |
| 4,569,518 | 2/1986 | Fulks | 272/129 |
| 4,634,127 | 1/1987 | Rockwell | 272/134 |
| 4,673,180 | 6/1987 | Rice | 272/128 X |
| 4,678,186 | 7/1987 | McIntyre et al. | 272/134 |
| 4,702,108 | 10/1987 | Amundsen et al. | 73/379 |
| 4,725,054 | 2/1988 | Solow et al. | 272/130 |
| 4,725,056 | 2/1988 | Rehrl et al. | 272/134 |
| 4,902,008 | 2/1990 | Jones | 272/134 |

*Primary Examiner*—Robert Bahr
*Attorney, Agent, or Firm*—William E. Mouzavires

[57] ABSTRACT

Method of testing muscles of the lower trunk of a subject human body including the steps of restraining the pelvis against movement, connecting to a movement arm a resistance weight of known force less than the maximum static strength of said muscles, having the subject move the resistance weight by exerting the muscles to pivot the movement arm in one direction to lift the resistance weight and then in an opposite direction to relieve the force on the movement arm to cause the resistance weight to return to its starting position, repeating the steps until the muscles fatigue and, wherein there is a further included the steps of counter-balancing the upper trunk by a counter-weight connected to the movement arm and wherein the stroke of the resistance weight is limited to three inches in order to reduce kinetic energy of the weight.

9 Claims, 4 Drawing Sheets

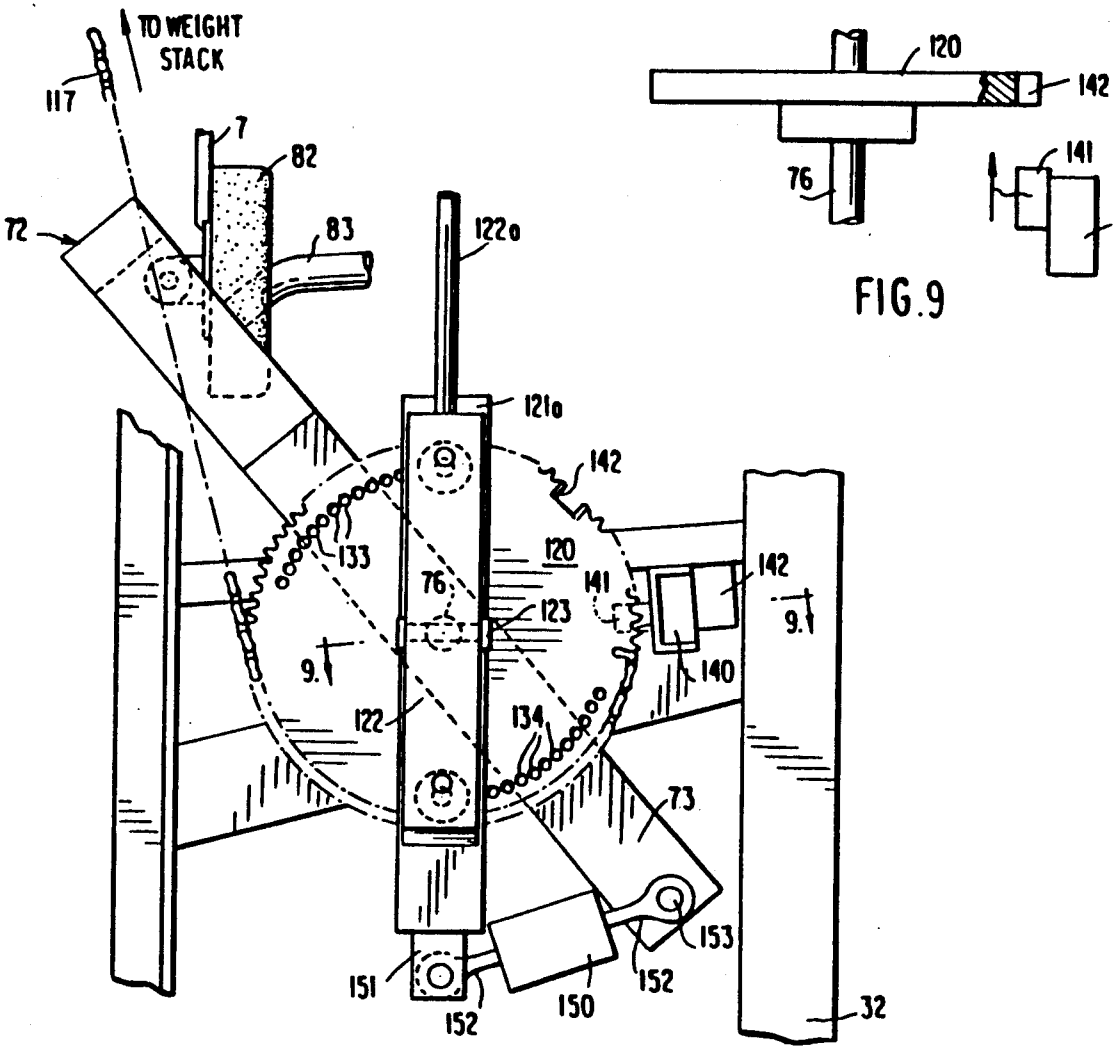
FIG. 8
FIG. 9
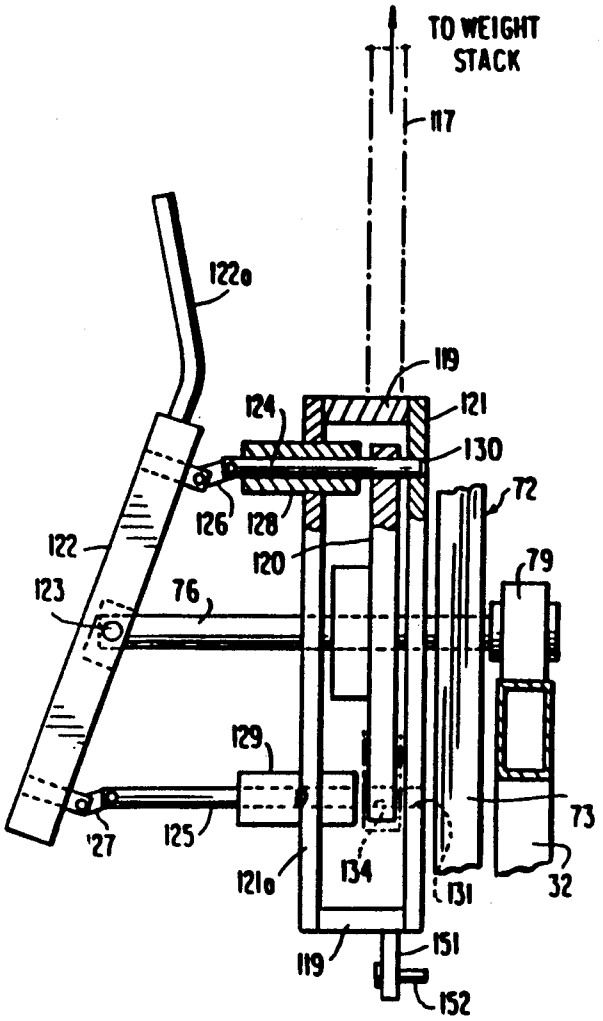
FIG. 7

METHOD FOR EXERCISING AND/OR TESTING MUSCLES OF THE LOWER TRUNK

RELATED APPLICATIONS

This application is a division of my prior copending application Ser. No. 07/422,905, filed Oct. 18, 1989, now U.S. Pat. No. 5,005,830 which in turn is a division of my prior application Ser. No. 07/236,367, filed Aug. 25, 1988, now U.S. Pat. No. 4,902,009, which in turn is a continuation-in-part of my prior U.S. patent application, Ser. No. 07/060,679, filed Jun. 11, 1987, now U.S. Pat. No. 4,836,536, and entitled "Method and Apparatus for Testing or Exercising Muscles of the Lower Trunk of the Human Body"; and Ser. No. 07/181,372, filed Apr. 14, 1988, now U.S. Pat. No. 4,834,365, and entitled "Compound Weight System". The disclosures of my above-identified patent applications are hereby incorporated by reference into the instant application as part hereof.

The present invention is also related to my prior application Ser. No. 07/259,305 filed Oct. 18, 1988, now U.S. Pat. No. 4,902,008, which is a division of my prior application, Ser. No. 07/60679 identified above.

BACKGROUND AND OBJECTS OF INVENTION

The present invention relates to a machine for exercising or testing muscles of the lower trunk such as the lumbar or abdominal muscles. The machine is of the type disclosed in my prior copending application Ser. No. 07/060,679 identified above. Another machine for exercising such muscles is disclosed in U.S. Pat. No. 4,462,252 to Smidt et al., issued Jul. 31, 1984. The present invention also relates to a method utilizing the machine for exercising or testing the lumbar or abdominal muscles.

In machines such as identified above, the exerciser is seated with his pelvis restrained against movement, and in the case of lumbar exercise, the lumbar muscles are exerted to extend the spine rearwardly to move a movement arm about a horizontal axis. The forces of the lumbar muscles are transmitted to the movement arm through a resistance pad engaged by an upper back portion of the exerciser. A resistance is connected to the movement arm to load the movement arm against the forces applied by the muscles. The torque applied by the muscles to the movement arm may be measured to determine the work capacity of the exerciser. In another mode of the machine, the movement arm is fixed so that the static strength of the muscles may be tested.

An object of the present invention is to provide certain novel improvements to a machine of the type described in order to facilitate the operation and accuracy thereof. Included herein is the provision of such a machine having novel apparatus for anchoring the pelvis against movement. Also included is provision for detecting any unwanted movement of the pelvis during exercise.

Further included within the objects of the present invention is such a machine having novel apparatus for accurately measuring the force of torque applied to the movement arm by the muscles being tested.

Another object of the present invention is to provide such a machine of the type described having novel apparatus for counterbalancing the torso mass of the exerciser so that it will not affect the accuracy of the measurements of torque or force applied by the muscles being tested or exercised.

A further object of the present invention is to provide such a machine of the type described having novel apparatus for varying the range of movement of the movement arm during an exercise mode or for placing the movement arm in different angular fixed positions for testing the static strength of the muscles in each of those positions.

A still further object of the present invention is to provide a novel method for testing the static strength and work capacity of the lumbar or abdominal muscles with little, if any, risk of injury to these muscles.

SUMMARY OF THE INVENTION

The present invention provides novel improvements in a machine for testing or exercising the lumbar or abdominal muscles of the human body. The machine includes a novel mechanism for exerting on the legs of the subject while seated, an upward and rearward force to pivot the femurs about a thigh strap to move the pelvis downwardly and rearwardly to anchor the pelvis against a pelvic pad. To indicate any unwanted movement in the pelvis, the pelvic pad is mounted for rotation about its own axis and any rotation of the pad is detected by a device associated with the pad.

The machine further includes a movement arm to be pivoted by the subject about a horizontal axis. Pivotably mounted to the movement arm is a resistance pad engaged by the upper torso of the subject, and in accordance with the invention, the amount of movement of the resistance pad relative to the movement arm in different angular positions of the subject's torso is measured in order to calculate the effective moment arm of the force or moment applied to the movement arm by the subject.

In order to neutralize the effect of the subject's torso mass during exercise or testing, a novel counterweight assembly is mounted to the machine to be releasably connected to the movement arm. The assembly includes at least one counterweight whose position relative to the pivot axis of the movement arm is adjustable to counterbalance the torso mass of a particular subject. In the preferred embodiment, a register is associated with the assembly to indicate when the torso mass is balanced upon movement of the counterweight.

The machine further includes a novel compound, resistance-weight, system for providing a predetermined load on the movement arm which load must be overcome by the subject to pivot the movement arm when exercising or being tested for work capacity. A novel drive transmission is provided for establishing a drive between these resistance weights and the movement arm. The drive may be disconnected to allow the movement arm to pivot free of the load of the resistance weight. The movement arm may be placed in a number of different angular positions relative to the horizontal and locked in each such position for testing the static strength of the lumbar or abdominal muscles in each position.

The present invention also includes a novel method of exercising or testing the work capacity of the lumbar or abdominal muscles wherein the subject repeatedly pivots the movement arm in one direction upon performing "positive" work with the muscles and in the opposite direction upon performing "negative" work with the muscles until the muscles fatigue and are no longer capable of performing positive work. In accordance with the invention, the resistance weight which loads the movement arm is chosen so that its force imposed on the movement arm will be safely less than the static maximum strength of the subject's muscles being tested or exercised. Moreover, the resistance weight is free-standing and yieldable so that no harmful impact loads are imposed on the subject's muscles.

DRAWINGS

Other objects and advantages of the present invention will become apparent from the following, more detailed description taken in conjunction with the attached drawings in which:

FIG. 7 is an enlarged, fragmental partly cross-sectional view f the left-hand portion of FIG. 2;

FIG. 8 is a side view of FIG. 7; and

FIG. 9 is a schematic cross-sectional view taken generally along lines 9—9 of FIG. 8.

DETAILED DESCRIPTION

Figure 1:
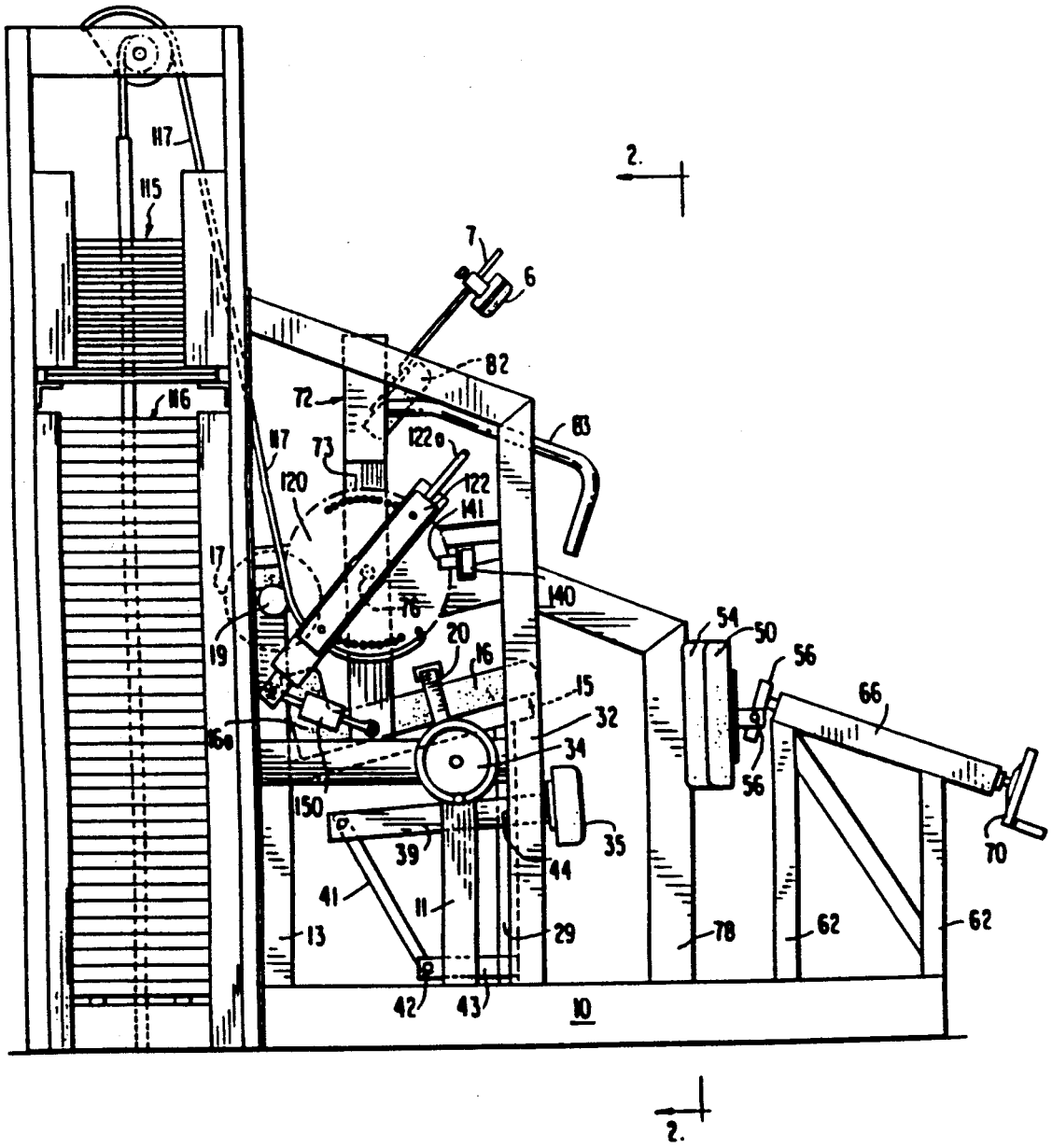
FIG. 1 is a side elevational view of a machine for exercising and/or testing the lumbar muscles of the human body and constituting a preferred embodiment of the present invention.

Referring now to the drawings in detail there is shown for illustrative purposes, a preferred embodiment of a machine of the present invention for exercising and testing the lumbar muscles of the lower trunk of the human body.

SEAT AND PELVIC RESTRAINT PAD

Figure 2:
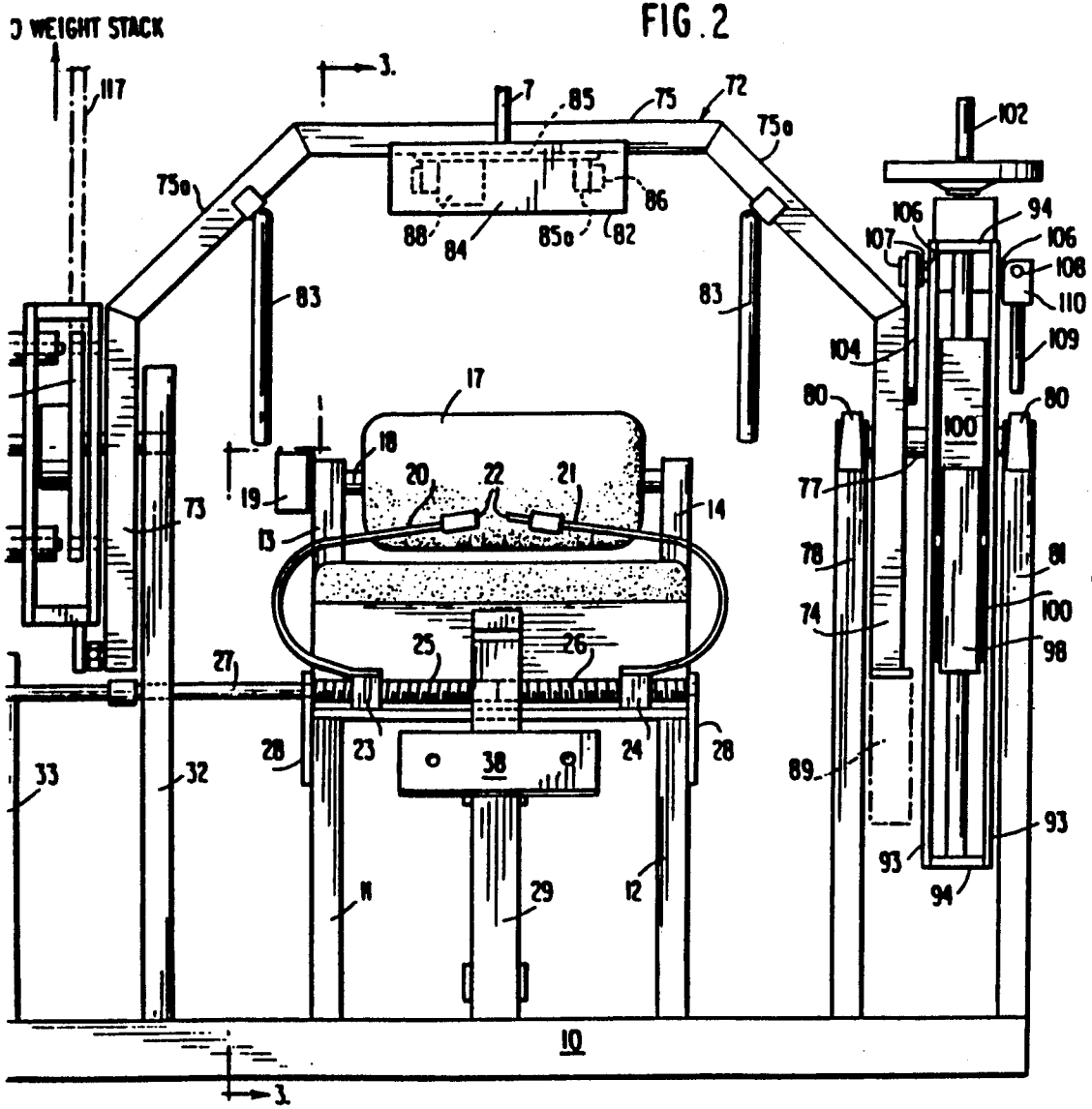
FIG. 2 is a cross-sectional view taken generally along lines 2—2 of FIG. 1.
Figures 3, 5, 6:
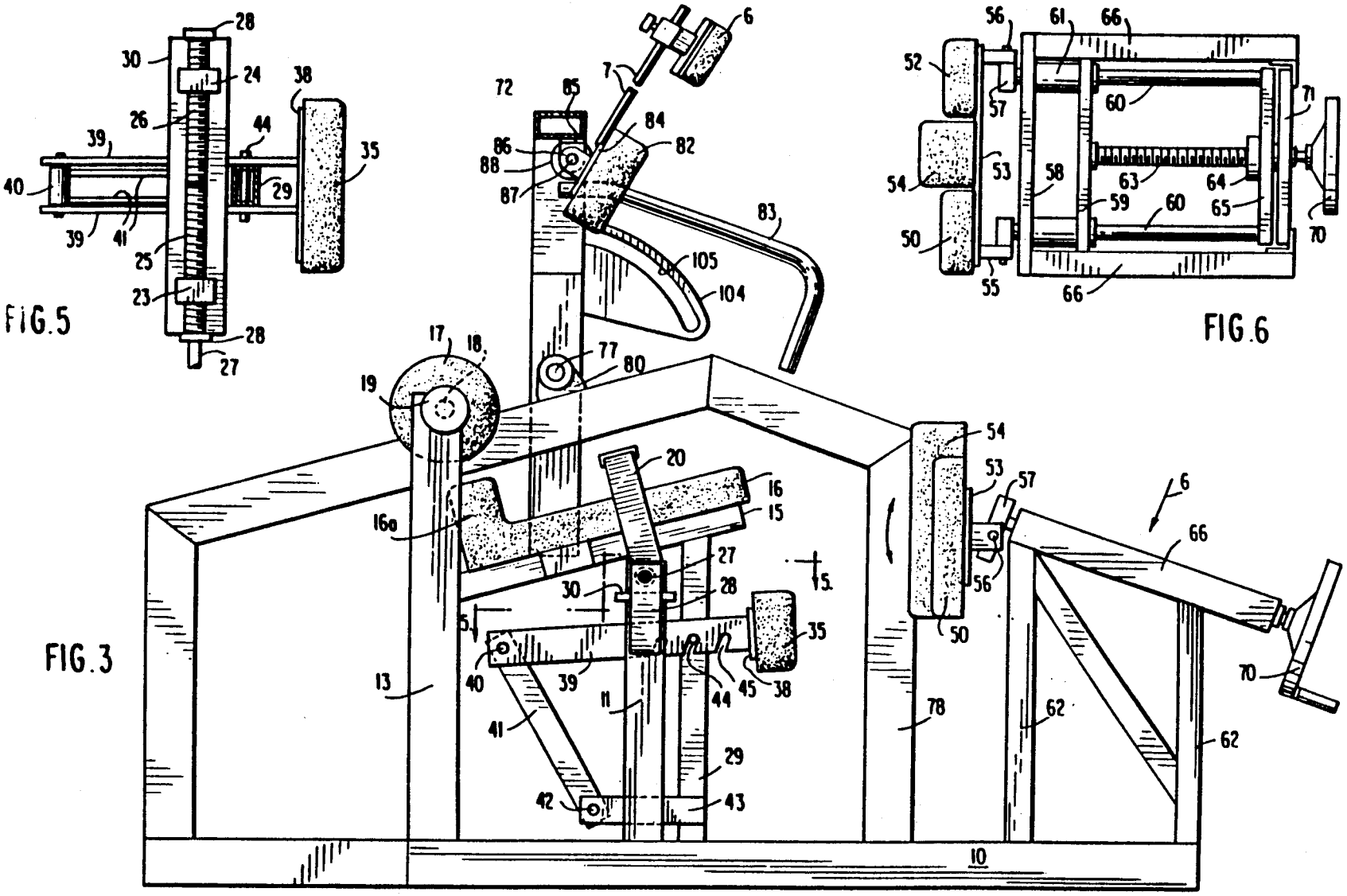
FIG. 3 is a cross-sectional view generally along lines 3—3 of FIG. 2.
FIG. 5 is a cross-sectional view taken generally along lines 5—5 of FIG. 3.
FIG. 6 is a fragmental view in the direction of arrow 6 of FIG. 3.

Referring initially to FIGS. 1, 2 and 3, the machine includes a horizontal base 10 having generally centered thereon a seat assembly including upstanding front legs 11 and 12 and rear legs 13 and 14 supporting a seat frame 15 carrying a suitable padded seat 16 which extends rearwardly downwardly at an angle of about 15° (degrees). Seat 16 includes a small upstanding rear rest **16*a* for positioning the buttocks and the pelvis, and just above the rear rest 16*a* is a pelvic restraint pad 17 mounted on a shaft 18 at the elevation of the pelvis for restraining the pelvis against rearward movement. Shaft 17 is suitably mounted for rotation in the rear legs 13 and 14 with the pelvic pad 17 fixed to the shaft for rotation therewith. For reasons to become clear below, and in accordance with a feature of the present invention, the pad 17 is rotatable to detect any unwanted movement of the pelvis during an exercise or test. Rotation of the pelvic pad 17 may be detected in any suitable manner such as, for example, by a goniometer 19 mounted to shaft 18 as shown in FIG. 2**.

THIGH RESTRAINT

In order to further restrain the pelvis against movement, a pair of thigh straps 20 and 21 are provided over the seat as shown in FIG. 2. A suitable buckle assembly 22 is provided on the upper ends of the thigh straps to releasably connect them over the thighs of the exerciser. Thigh straps 20, 21 are suitably tensioned by means of a non-advancing screw mechanism best shown in FIGS. 2 and 5. The mechanism includes left and right-handed screw portions 25 and 26 formed on a shaft 27 below the seat 16 with non-turning nuts 23 and 24 threaded on screw portions 25 and 26 respectively. Nuts 23 and 24 rest on and are prevented from rotating by a flat plate 30 which extends horizontally below the screw portions and is fixed to legs 11 and 12. The lower ends of thigh straps 20 and 21 are fixed to nuts 23 and 24 respectively such that rotation of screw portions 25 and 26 will cause the nuts 23, 24 to move towards or away from each other depending on the direction of rotation of shaft 27 to loosen or tighten the thigh straps 20, 21. As the nuts 23 and 24 are square with four flat sides, the plate 30 which engages one of the flat sides of the nuts will prevent rotation of the nuts thus causing the nuts to only advance or retract along the screw portions upon rotation of the shaft 27. Shaft 27 is mounted for rotation in plates 28 fixed to the legs 11 and 12. Additionally, shaft 27 extends outwardly wherein it is also supported by vertical frames 32 and 33 upstanding from base 10 as shown in FIG. 2. Rotation of shaft 27 to actuate the thigh straps 20, 21 is effected by a handwheel fixed to the shaft 27 outwardly of frame 33.

LEG AND PELVIC RESTRAINT

Referring to FIGS. 3 and 5, the rear of the legs are supported and restrained generally at the calves by what will be termed a "calf pad" 35 fixed to a mounting plate 38 below the seat. Mounting plate 38 is fixed across the front end of a pair of parallel support links 39 whose rear ends are pivotably mounted by pivot 40 to vertical links 41 which, in turn, are pivotally mounted by pivot 42 to base links 43. The latter are fixed to the bottom of a stationary vertical leg 29 which is centered below the seat and fixed to and between the base 10 and seat frame 15 as shown in FIGS. 2 and 3. It will thus be seen that links 39 and 41 form a linkage for extending or retracting the calf pad 35 to suit the size of a particular exerciser. In the specific embodiment shown, the several possible positions of the calf pad 35 are determined by slots 45 notched into the lower edges of links 39 to receive a pin 44 fixed in and projecting from opposite sides of the leg 29 as best shown in FIG. 5; it being understood that the links 39 straddle the opposite sides of leg 29.

In order to anchor the pelvis against movement, leg restrainers including pads 50 and 52 are provided in front of the seat 16 to engage the front of the legs below the knees and to impose a force against the femurs to hold the rear ends of the femurs downward which, in turn, anchors the pelvis since the rear ends of the femurs are connected tot he pelvis. The slope and height of seal 16 is designated such that when one is seated, the tops of the thighs should be approximately horizontal which means that the midline of the femurs will be sloping upwards from their pelvic sockets at an angle of about 10° (degrees), with the knee-ends of the femurs slightly higher than the hip ends of the femurs. In accordance with the present invention, the leg pads 50, 52 which may be termed "shin pads", drive the femurs in an upward and rearward direction at an angle of about 30° (degrees) as shown in FIG. 3 in relation to the midline of the femurs, thus rotating the femurs about the thigh straps 20, 21 which form a fulcrum, to rotate the hip-ends of the femurs downwardly to thus hold the pelvis down against any movement.

Referring to FIGS. 3 and 6, in the present embodiment shown, the shin pads 50, 52 are fixed to a mounting plate 53 which, in turn, is mounted to a slide assembly to drive the pads forwardly or rearwardly. Between pads 50, 52 is a pad 54 received between the legs to properly space the legs and to prevent movement of the legs toward each other. The mounting plate 53 is provided with apertured ears 55 mounted by pivots 50 to lugs 57 fixed on the front of a slide including a pair of parallel slide rods 60 extending forwardly and upwardly at an angle to about 20° (degrees) and with their rear ends connected by a yoke 65. The forward ends of slide rods 60 are slidably received in a pair of bushings 61 fixed between a pair of cross supports 58 and 59 extending between and fixed to a pair of side frame rails 66 which are supported in fixed position b legs 62 upstanding from base 10. Slide rods 60 are actuated forwardly or rearwardly to advance or retract shin pads 50, 52 by means of a non-advancing screw 63 having one end rotatably held in crosspiece 59 and an opposite end threaded in a non-rotating nut 64 fixed to yoke 65. The rear end of the screw 63 extends through a cross frame piece 71 fixed to and between frame rails 66. Rotation of screws 63 by means of a hand wheel 70 will move yoke 65 and slide rods 60 to advance or retract the shin pads depending on the direction of rotation of the screw 63. Because of the forward and upward angle of the slide rods 60, the thin pads 50, 52 when advanced, will have the effect of rotating the femurs about the thigh strap as a fulcrum, to drive the hip-ends of the femurs rearwardly and downwardly to, in turn, securely anchor the pelvis against movement. During such action, the thighs will be prevented from upward movement by the thigh straps 20, 21 and the rear of the pelvis will be restrained by the seat 16, pelvic pad 17 and the rear seat rest 16*a*.

THE MOVEMENT ARM

The forces generated by the lumbar muscles are transmitted to a movement arm generally designated 72 to pivot the movement arm about a horizontal axis. The movement arm has a generally inverted U-shape including opposite sides 73 and 74 positioned on opposite sides of the seat 16 and a crosspiece or yoke overlying the seat 16 and connected to the sides 73 and 74. In the specific embodiment shown, the yoke includes a horizontal top piece 75 and angled end portions 75*a* interconnecting the top piece 75 and the sides 73 and 74. The pieces of the movement arm 72 in the preferred embodiment are made from tubular steel or aluminum alloy welded together into a rigid structure. The movement arm is mounted for pivotal movement about a horizontal axis by shafts 76 and 77 respectively received through the sides 73 and 74 of the movement arm. Referring to FIGS. 7 and 2, shaft 76 is journalled in a bearing 79 fixed on stationary frame 32 while the other shaft 77 is journalled in two bearings 80 fixed to stationary frames 78 and 81 in laterally spaced relation on opposite sides of the movement arm to accommodate a counterweight assembly mounted to the shaft 77 as will be described below. Movement arm 72 is rotatable about shaft 77 and a suitable bearing is provided therebetween.

During an exercise or static strength test, the forces exerted by the lumbar muscles are transmitted to the movement arm 72 by what is termed herein a resistance pad 82 mounted centrally of the top crosspiece 75 on the inside thereof to be engaged by the back. The work capacity of the lumbar muscles during an exercise is measured in terms of foot pound seconds with the aid of a computer, and to determine the foot pounds or torque applied by the lumbar muscles, it is necessary to determine the lever arm or distance between the point of application of the force to the movement arm at the resistance pad 82 and the pivotal axis of the spine as it moves through a predetermined range of movement between a generally upright or forwardly bent position and a rearwardly extended position. However, as the length and pivotal axis of the spine changes during the aforementioned exercise movement, it is necessary to compensate for such changes. In accordance with another aspect of the present invention, the resistance pad 82 is mounted to the movement arm to be rotatable relative thereto, and the angular movement of the resistance pad is measured as the exercise proceeds, to determine the length of the effective lever arm of the forces applied to the movement arm. In the preferred embodiment, the resistance pad is mounted to the movement arm by a plate 84 heaving apertured lugs 86 pivoted by pivots 87 to apertured flanges 85*a* of a mounting plate 85 fixed to the underside of the top crosspiece 75 of the movement arm as shown in FIGS. 2 and 3. Mounted on the resistance pad 82 in associated with one of the pivots 87 is a goniometer 88 for measuring the angular movement of the resistance pad relative to the movement arm during an exercise.

Since the head and arms constitute a meaningful part of the total body mass, and since unwanted relative movement of either the head and arms or both will change the body mass torque, it follows that the head and arms must remain in a fixed position relative to the movement arm during a test or exercise. In the preferred embodiment shown, the arms are fixed in position by means of a pair of bars 83 fixed to the movement arm 72 and extending forwardly from the opposite sides thereof to be conveniently grasped by the hands at handle portions located at the forward extremities of the bars 83. The head is held in fixed position by contoured support pad 6 adjustably mounted on a rod 7 fixed centrally to the mounting plate 84 of the resistance pad 82.

In order to eliminate the effect of torque that would otherwise be imposed by the mass of the movement arm 72 itself, a fixed counterweight 89 is connected to one of the sides 73 of the movement arm below the horizontal pivot axis of the movement arm which axis is, of course, determined by pivot shafts 76 and 77.

ADJUSTABLE COUNTERWEIGHT ASSEMBLY

Figure 4:
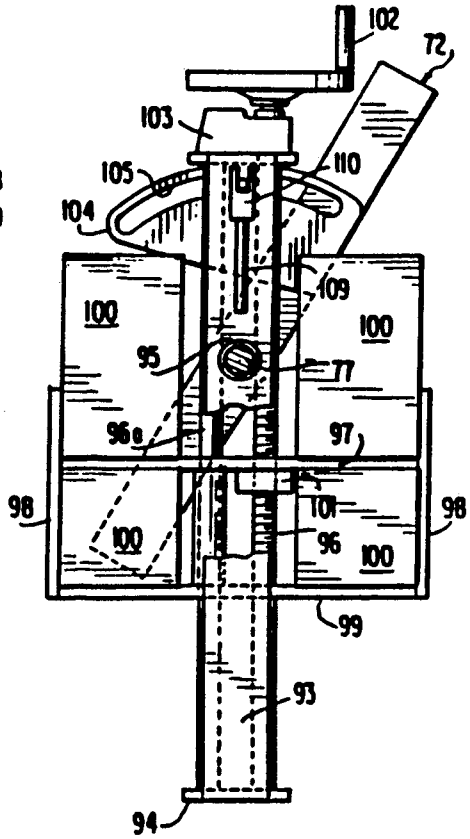
FIG. 4 is a fragmental side elevational view of the machine as shown in FIG. 2.

Since the torso mass of the persons using the machine will vary from person to person, it is necessary to provide an adjustable counterweight in order to balance out the effect of the torque produced by the torso mass of the person using the machine. In the preferred embodiment as shown in FIGS. 2 and 4, there is provided an adjustable counterweight assembly including an elongated frame mounted for rotation about pivot shaft 77 between bearings 80 and including a pair o elongated side plates 93 fixed between top and bottom end plates 94. Side plates 93 are apertured at 95 to receive pivot shaft 77 as shown in FIG. 4, and on opposite sides f shaft 77 there is provided an elongated actuating screw 96 and a guide rod 96*a*. Mounted to the actuating screw 96 is a weight carrier including opposite end plates 98 vertically upstanding from a base plate 99 and interconnected by a horizontal divider plate 97 to define upper and lower compartments on opposite sides of the screw and guide rod assembly 96, 96*a* for receiving weights 100, there being four weights 100 shown in FIG. 4. A non-rotating nut 101 is fixed to the divider plate 97 such that upon rotation of the screw 96, the weight carrier will be raised or lowered depending upon the direction of rotation of the screw 96. A hand wheel 102 is connected through at suitable gearing in a housing 103 to the upper end of the screw 96 for rotating the screw, and a register is provided in the gear housing 103 to give a visible display of the position of the weight carrier along the screw to indicate when the torso mass has been balanced by the counterweight assembly.

Prior to adjusting the counterweight assembly to balance out the weight of the torso mass of the person exercised or tested, it is necessary to align the centerline of the torso mass (extending through the center of mass of the torso) with the centerline of the counterweight assembly (extending through the center of mass thereof). This is achieved by positioning the person after restrained (on the seat 16 as described above) at top dead center with the movement arm 72 at rest. The counterweight assembly is then connected to the movement arm 72 by means of a releasable coupling. In the preferred embodiment shown, this coupling includes a pressure plate 104 fixed to the side 74 of the movement arm 72 and having an arcuate slot 105 (see FIG. 4) extending in the pivotal direction of the movement arm for accommodating adjustment of the movement arm to align the centerlines of the torso mass and the counterweight assembly as described above. Received through the slot 105 and the opposite sides 95 of the screw frame is a longitudinally reciprocable actuating shaft for applying pressure, through a thrust tube 106 telescoped thereon, on clamp washers 107 positioned on opposite sides of pressure plate 104 for clamping the pressure plate therebetween when the shaft is moved in one direction and for releasing the pressure plate from the clamp washers 107 when the shaft is moved in the opposite direction. The actuating shaft is actuated to the aforesaid positions by a hand lever 109 having a block cam 110 pivoted to the shaft to engage the thrust tube 106 to press the washers on the pressure plate 104 when the lever is moved into the position shown in FIG. 2 and to release the washers 107 when the lever 109 is moved to a horizontal position.

RESISTANCE WEIGHT FOR LOADING THE MOVEMENT ARM

During the exercise mode of the machine, the movement arm is loaded with a yieldable resistance preferably in the form of one or move dead weights which are lifted upon extension of the spine producing rearward movement of the movement arm and lowered upon return of the spine to the starting position, wherein the spine is bent forward and has moved up to about 72 (degrees) from the position of full extension. Lifting of the weights through forces exerted by the lumbar muscles is positive work and lowering of the weights is negative work. As will be described further below, the magnitude or force of the resistance weights selected in any given exercise according to the method of the present invention is safely less than the maximum strength of the lumbar muscles as initially determined through a static strength test to be described.

Shown in FIG. 1 is a compound weight stack preferably employed to provide the resistance weight for exercise with the machine. The weight stack includes two independent groups of weights 115 and 116 with the weights of one group being substantially less in magnitude than that of the other group to thus enable precise weight selection suitable to the strength of a particular exerciser. One or more weights of each group may be connected to a cable or chain 117 to furnish the desired yieldable resistance to movement of the movement arm. A more detailed description of the compound weight stack may be gained by reference to my prior copending U.S. application Ser. No. 07/181,372 identified above and incorporated by reference into the disclosure of the present application as part hereof.

DRIVE TRANSMISSION BETWEEN RESISTANCE WEIGHT AND MOVEMENT ARM

The resistance weights are connectible and disconnectible to the movement arm by means of an appropriate transmission system which in the preferred embodiment includes a sprocket and toggle assembly mounted on the pivot shaft 76 of the movement arm. Referring FIGS. 2, 7 and 8, this assembly includes a sprocket 120 rotatably mounted about the pivot shaft 76 of the movement arm 72. The chain 117 from the resistance weight stack is trained about the sprocket 120.

In order to drivingly connect the sprocket 120 to the movement arm 72 to drive the sprocket to lift the resistance weight, a toggle assembly is provided including a pair of keeper plates 121, 121*a* mounted for rotation about the shaft 76 on opposite sides of the sprocket 120. Connected between the top and bottom of keeper plates 121 and 121*a* are spacers 119. In the preferred embodiment shown, the movement arm 72 is connected to the spacer 119 of the keeper plates so that when the keeper plates are connected to the sprocket 120 as will be described below, a drive will be established between the movement arm 72 and the resistance weight stack. The toggle assembly further includes a toggle lever 122 having an intermediate portion thereof connected such as by pivot pin 123 to the outer end of shaft 76 so that the toggle level 122 is rotatable with shaft 76 while being pivotable in the longitudinal direction of the shaft 76. Provided on opposite end portions of the toggle lever 122 are a pair of toggle pins or latch pins 124 and 125 to be engaged in the sprocket 120 for establishing a drive connection between the sprocket 120 and the movement arm 72. In the specific embodiment shown, toggle pins 124 and 125 are connected by small links 126 and 127 to the toggle pins and toggle lever. Toggle pins 124 and 125 are slidably mounted in bushings 128 and 129 fixed in opposite end portions of keeper plate 121*a*. The other keeper plate 121 has upper and lower apertures 130, 131 in alignment with and to receive the toggle pins 124, 125 respectively when either of the pins is extended to engage the sprocket 120.

As shown in FIG. 8, sprocket 20 is provided with an upper and lower set of angularly spaced apertures 133, 134 for receiving toggle pins 124 and 125 respectively. Each of the apertures 133 and 134 provides a different angular setting between the toggle lever 122, pivot shaft 76, movement arm 72 and the sprocket 120, it being understood that the movement arm 72 rotates together with the pivot shaft 76 and toggle lever 122. In order to select any of the angular settings of the upper apertures 133, the toggle lever 122 is pivoted counterclockwise as viewed in FIG. 7 to a neutral position shown in FIG. 2 where both toggle pins 124 and 125 are retracted from any aperture in the sprocket 120. The lever 122 is then rotated in a plane perpendicular to the axis of shaft 76 to rotate the shaft 76 and the movement arm 72 until the desired angular setting is reached, and then the toggle lever 122 is rotated clockwise as viewed in FIG. 7, to extend the upper toggle pin 124 through the selected aperture 133 and the aperture 130 in the keeper plate 121 as shown in FIG. 7. If another angular setting corresponding to one of the lower apertures 134 is desired, the toggle lever 122 must, of course, be rotated counterclockwise as viewed in FIG. 7 to withdraw the upper toggle pin 124 from the upper aperture 133, then the toggle lever must be rotated to the new angular setting and ten the toggle lever must be pivoted counterclockwise to insert the lower toggle pin 125 in the selected aperture 134 and the aperture 131 of the keeper plate 121. A handle **122*a* is provided on the toggle lever to facilitate handling thereof. In the preferred embodiment shown, a total of twenty-three apertures 133 and 134 are provided in the sprocket 120** thus permitting twenty-three different angular positions of the movement arm for testing static strength of the lumbar muscles.

It will, of course, be understood that once the sprocket chain 117 is connected to the resistance weights, and one of the toggle pins 124 or 125 is engaged in the sprocket 120, the movement arm will be ready for an exercise during which rotation of the movement arm 72 counterclockwise as viewed in FIG. 8, will lift the weights as the sprocket 120 will be drivingly connected to the pivot shaft 76 of the movement arm by the toggle assembly. The different angular settings provided by apertures 133 and 134 will also allow the range of angular movement of the exercise to be adjusted to suit a particular person in an exercise. If desired, limit stops (not shown) may be provided between the sprocket 120 and the adjacent stationary frame portions to limit the opposite rotative positions of the sprocket 120.

STATIC STRENGTH TEST APPARATUS

The different angular setting of the movement arm 72 as determined by the apertures 133 and 134 is also used to test the static strength of the lumbar muscles in each of the different angular positions of the spine as will be determined by the angular set of the movement arm. In order to effect this test, it is necessary to fix the movement arm against movement in the angular position selected. In the preferred embodiment shown, this is accomplished by locking the sprocket 120 by any suitable means such as by a lock bar 140 having a lug 141 receivable in an aperture 142 formed in the periphery of sprocket 120 as shown in FIGS. 8 and 9. Lock bar 140 is slidably mounted to a stationary frame member 142 to be slid by hand inwardly to engage in the sprocket recess 142 or outwardly to disengage from the recess 142. Since in selecting the angular orientation of the movement arm 72 for the test, one of the toggle pins 124 or 125 has been inserted in one of the apertures 133 or 134 of the sprocket 120, the pivot shaft 76 of the movement arm will also be locked against movement to thereby prevent rotation of the movement arm when the person being tested exerts a force on the movement arm for purposes of testing the static strength of the lumbar muscles.

Referring to FIGS. 7 and 8, in order to measure the static strength of the lumbar muscles, the preferred embodiment of the machine utilizes a strain gauge 150 connected between the lower end portions of the movement arm 72 and the spacer 119 of the keeper plates 121, **125*a* by eye bolts 152 received about pins 153 fixed on the movement arm and a strap 151 depending from spacer 119**. The static strength of the lumbar muscles is measured at different angular orientations of the movement arm since the static strength will vary depending on the angular orientation of the spine. In this way, an accurate measure of strength is obtained over a range of spine positions so as to correlate strength with angular position of the spine.

METHODS OF TESTING AND EXERCISE

As described above, the machine of the invention described above is capable of measuring static strength of the lumbar muscles when the movement arm 72 is locked stationary. In addition, the machine is capable of measuring the work capacity of the lumbar muscles when the movement arm 72 is free to rotate against the load of the resistance weight. The latter mode is also employed to exercise the lumbar muscles to strengthen or rehabilitate them.

Before testing for work capacity, the static strength of the fresh lumbar muscles is first determined over a range of different angular positions of the spine between the bent forward position and fully extended position. A graph of the static strength is produced and recorded through a computer and displayed on a video screen as the test proceeds. Once the static strength is determined, then the resistance weight is selected for the work capacity test to be less, as much as 30% (percent) or more than the maximum static strength so that there will be no chance of injuring the lumbar muscles during the work capacity test.

In the work capacity test, the subject is asked to pivot the weighted movement arm 72 rearwardly to perform "positive work" and forwardly to perform "negative work" and to repeat the process over a predetermined range of movement until the lumbar muscles fatigue and can no longer produce positive work. A graph of the work capacity test is produced and recorded through the use of a computer, the graph measuring the work capacity in terms of pound seconds over a predetermined range of movement. Immediately following the work capacity test, the static strength of the subject is again measured over the same range of angular positions and a graph of this test is recorded so that the effect of the work capacity test on the lumbar muscles may be determined from a comparison of the graphs. This comparison may be used to determine the fiber-type of the lumbar muscles and their response to, and tolerance for, exercise. It may also be used to determine a specific injury or weakness existing in the lumbar once the relationship between static strength and work capacity is determined for a specific individual, in subsequent tests, static strength can be determined by measuring work capacity alone or work capacity can be determined by measuring static strength alone for the same individual. The reason this may be done is that when any given percentage of your existing level of strength is provided as resistance in a test of anaerobic endurance, then the resulting number of repetitions will always be the same, at any level of strength providing only that the style of performance is always a constant.

Thus . . . if, at an existing strength of 100, you can perform ten repetitions with 80, then if your strength is raised or lowered, to any degree, you will always perform only ten repetitions with eighty percent of the new level of strength. For example, strength 100 means ten repetitions with 80 or eighty percent. Thus strength 200 means ten repetitions with 160. Still eighty percent and strength 300 means ten repetitions with 240. Always eighty percent.

That exact ratio exists for some people, but not all people . . . a few can do only one repetition with eighty percent, and others can do forty repetitions with eighty percent. This relationship never changes except in cases of injury, and then returns to normal when rehabilitation is complete . . . but the individual ratio between these two factors, strength and endurance, must be established in each subject. Once this ratio is known in any individual case, then you can determine strength by measuring endurance, or can determine endurance by measuring strength.

SUMMARY OF OPERATION AND METHODS

To summarize operation of the machine in accordance with preferred methods of the invention, the subject is seated on seat 16 with his pelvis against pelvic pad 17 and his calves against calf support pad 35. Thigh straps 20, 21 are buckled over the thighs, and the hand wheel 34 is turned to sufficiently tension thigh straps 20, 21 to prevent upward movement of the thighs. The shin pads 54 are then extended against the legs by turning hand wheel 70 until the shin pads 54 rotate the femurs about the thigh strap 20, 21 to anchor the pelvis downwardly and rearwardly against the pelvic pad 17. The subject is then asked to bend his spine forwardly and rearwardly to see if any unwanted pelvic movement occurs causing the pelvic pad 17 to move as will be detected by the goniometer 19. If movement occurs, the shin pads 54 are extended a bit further until no movement of the pelvis occurs.

With the use of the toggle lever 122, both toggle pins 124 and 125 are removed from the sprocket 120 to free the movement arm 72 for rotation. The subject and the movement arm 72 are then moved into the dead center position with the head and arms fixed in position as determined by the head and arm rests. Lever 109 is then pivoted to actuate clamp washers 107 against the pressure plate 104 to connect the counterweight assembly including counterweights 100 to the movement arm. The subject is moved to the rear position and the torque of the torso mass is read from the digital register associated with the counterweight assembly. Hand wheel 102 is then rotated to raise or lower the counterweights 100 until the torso mass is balanced about the pivot shaft 77 as will be indicated when the digital register reads zero.

The lock bar 110 is moved inwardly to engage the lug 141 in the aperture 142 of the sprocket 120 to lock the sprocket 120 against movement. The several angular positions for each test are selected and the toggle lever 122 is manipulated to lock the movement arm at each position. At each position, the person is asked to rest against the resistance pad 82 and a reading from the goniometer 88 associated with the resistance pad 82 is taken at each position. This reading is then introduced into the computer along with each of the angular positions to enable the computer to determine an accurate measure of strength at each position. The subject is now ready to start the actual strength test.

The movement arm 72 is rotated to the first position for the static strength test and the toggle lever 122 is then pivoted to insert one of the toggle pins 124 or 125 into one of the apertures 133 or 139 corresponding to the desired position.

The subject then grasps the arm supports 83 and positions his head against the head pad 6 to thus fix the positions of the head and arms relative to the movement arm 72. With his back already resting against the resistance pad 82 to avoid impact forces, the subject is then asked to exert slowly and gradually as much force as possible with his lumbar muscles to transmit a force through the resistance pad 82 to the movement arm. When the subject reaches the highest lever of force, he should relax until no force is produced on the resistance pad. The force applied is reflected in the strain gauge 150 whose reading is fed into the computer to calculate the actual strength applied by the lumbar muscles. A graph of this strength is produced and recorded. The toggle lever 122 is then manipulated to retract the toggle pin and move the moment arm to the next test position at which time a toggle pin is inserted in the corresponding aperture 133 or 134 and the strength test is repeated for this position. The process is repeated for each of the selected positions and the recorded graph will reflect the maximum strengths at each of these positions by a line interconnecting the maximum strengths at each position.

When a subject is being tested for the first time, the work capacity test should immediately follow the static strength test of the fresh lumbar muscles. Additionally, immediately following the work capacity test, the subject is again tested for static strength to determine the effect of the work capacity test on the lumbar muscles.

In conducting the work capacity test, it is important that the resistance weight selected be safely less than the maximum static strength of the lumbar muscles. Having already conducted the static strength test of the fresh lumbar muscles, a safe resistance weight may be accurately selected using the compound weight stack of the present invention. For example, if the maximum static strength of the subject's lumbar muscles is 100, a resistance weight of 70 may be selected for the work capacity test.

In conducting the work capacity test, the subject is still held in the seat with his pelvis restrained against movement. The appropriate resistance weights are connected to the sprocket chain 117. The lock bar 140 is then retracted from the sprocket 120 to free the sprocket for rotation by the movement arm. The toggle lever is then operated to place one of the toggle pins 124, 125 into the appropriate aperture 133 or 134 of the sprocket to determine the range of movement of the movement arm in accordance with the capability of the subject as well as to establish the drive between the movement arm 72 and the sprocket 120. With his head and arms maintained in fixed positions as determined by the head and arm supports the subject is bent forward to a position of a bit less than 72 degrees; meaning that they are bent forward by that number of degrees from a position of full lumbar-extension . . . some subjects can bend more, some less, but a safe starting position should be used in all cases, a pain-free position. In that position, at the start of the test, the subject is instructed to start producing force . . . very gradually, in the smoothest manner possible avoiding any sudden muscular contractions or jerky movements.

The test of work-capacity is now underway . . . having been started in the safest possible manner. Since the level of force was increased very slowly, the subject had plenty of time to reduce these forces at the first sign of pain or discomfort; forces that might cause an injury were thus avoided.

As the movement proceeds to the left across the chart, the computer will draw a thin line which displays the exact level of force in every position . . . even through the actual level of force steadily drops off as movement occurs, must drop off since you are weaker in the more extended positions, drops off as a consequence of the cam associated with the sprocket chain of the resistance weight that varies the resistance throughout the movement, changes the level of resistance as you change position, always keeping an appropriate level of resistance in every position.

When the subject has moved as far back as they can in a safe manner, then the subject should pause in that rear position for a very brief period, for a second or less . . . which pause is required to assure that he can pause and hold that position; because, if he cannot pause and hold against the level of resistance in that position, then he did not move into that position by muscular contraction in the first place . . . instead, coasted into that must stop.

That concludes the test . . . do not attempt to continue the movement by jerking, you may be able to continue for one or two more repetitions by jerking and thus stimulating the pre-stretch reflex . . . but doing so unavoidably creates levels of force that are not safe enough for test purposes, and that are not required for test purposes in any case.

When positive movement becomes impossible, pause briefly in the position where you failed, then slowly bend forwards to the starting position, and upon reaching the starting position gradually reduce the level of muscular force to zero. The test is finished, the computer has all the information it needs to calculate your work-capacity . . . and you have provided that information in the safest possible manner, never exposing yourself to high and perhaps dangerous levels of force at any time during the test. The results of the work capacity test are recorded on a graph for comparison with future work capacity tests. Following the work capacity test, a subject (being tested for the first time) is again tested for static strength to compare the results with the first static test of the muscles which comparison gives highly useful information.

Once the relationship between static strength and work capacity for a particular individual is determined, it is only necessary to conduct work capacity tests in the future in order to determine that individual's static strength. Work capacity tests are preferable to static strength tests since the subject is safely moving a force less than the subject's maximum strength.

The work capacity mode of the machine may also be used to simply exercise the lumbar muscles in order to strengthen, condition or rehabilitate them. Once a subject has been tested position as a result of kinetic energy which resulted from too fast a speed of movement.

After a brief pause in the rear position, the subject leaves the position of full lumbar-extension and moves back towards the position where he started. This will produce a second thin line across the chart, now moving from left to right . . . as he performs the negative part of the first repetition, the force now increasing back towards its highest point as he moves towards his strongest position.

When the subject has moved forwards to the limit of safe movement, he must not relax and reduce the level of force . . . instead, immediately but smoothly he must start moving back to the rear as he starts the second repetition . . . now performing the positive part, the lifting part, of the second repetition. And so on . . . always moving slowly and smoothly, except for the very brief pauses in the rear position at the completion of the positive part of each repetition.

Continue in that fashion until continued movement is impossible . . . which will occur when the level of his positive strength drops even slightly below the level of resistance; and, in such a totally isolated test of lumbar function, he will fail before he expects to . . . he will be moving along in what feels like a rather easy manner, probably convinced that he can perform at least several more repetitions, and then with little or no advanced notice from his muscles that they are so fatigued, he will find continued movement impossible. It may surprise you the first time you take such a test.

This unexpected failure occurs because you cannot bring into play the strength of any other muscles in order to help the lumbar muscles continue . . . when the lumbar muscles become too fatigued to produce a force equal to the resistance then you and graphs of the test produced, a safe and effective exercise or rehabilitative program may be designed for a particular subject.

Although the invention has been shown and described with reference to application to the lumbar muscles, methods and apparatus in accordance with the invention may be applied to exercise and test the abdominal muscles of the human body without departing from the scope of the invention which is indicated in the appended claims.

What is claimed is:

1. A method of testing muscles such as lumbar or abdominal muscles of the lower trunk of the human body comprising the steps of seating a subject body on a seat with the pelvis restrained against movement to isolate movement of said muscles from the pelvis, connecting to a movement arm a resistance weight of known force less than the maximum static strength of said muscles to be lifted and lowered by the subject, having the subject move the upper trunk in one direction by exerting said muscles to apply a force to the movement arm to pivot the movement arm in one direction to lift said resistance weight and then move the upper trunk in an opposite direction to relieve the force on said movement arm to cause the resistance weight to lower and pivot the movement arm in said opposite direction, repeating said steps until said muscles fatigue and are no longer capable of pivoting the movement arm in said one direction and wherein the stroke of said resistance weight is limited to a distance on the order of three inches.

2. A method of testing muscles such as lumbar or abdominal muscles of the lower trunk of the human body comprising the steps of seating a subject body on a seat with the pelvis restrained against movement to isolate movement of said muscles from the pelvis, connecting to a movement arm a resistance weight of known force less than the maximum static strength of said muscles to be lifted and lowered by the subject, having the subject move the upper trunk in one direction by exerting said muscles to apply a force to the movement arm to pivot the movement arm in one direction to lift said resistance weight and then move the upper trunk in an opposite direction to relieve the force on said movement arm to cause the weight to lower and pivot the movement arm in said opposite direction, repeating said steps until said muscles fatigue and are no longer capable of pivoting the movement arm in said one direction and wherein there is further included the step of applying a movable pelvic pad against the rear of the pelvis of the subject to determine whether any unwanted movement occurs in the pelvis causing the pelvis pad to move.

3. A method of testing muscles such as lumbar or abdominal muscles of the lower trunk of the human body comprising the steps of seating a subject body on a seat with the pelvis restrained against movement to isolate movement of said muscles from the pelvis, connecting to a movement arm a resistance weight of known force less than the maximum static strength of said muscles to be lifted and lowered by the subject, having the subject move the upper trunk in one direction by exerting said muscles to apply a force to the movement arm to pivot the movement arm in one direction to lift said resistance weight and then move the upper trunk in an opposite direction to relieve the force on said movement arm to cause the weight to lower and pivot the movement arm in said opposite direction, repeating said steps until said muscles fatigue and are no longer capable of pivoting the movement arm in said one direction and wherein there is further included the step of applying a movable resistance pad pivotally connected to the movement arm to be engaged by the upper trunk of the body for transmitting the force to the movement arm from said muscles, and measuring the movement of said resistance pad relative to the movement arm to determine the moment arm of the forces applied to the movement arm.

4. A method of testing muscles such as a lumbar or abdominal muscles of the lower trunk of the human body comprising the steps of seating a subject body on a seat with the pelvis restrained against movement to isolate movement of said muscles from the pelvis, connecting to a movement arm a resistance weight or known forces less than the maximum static strength of said muscles to be lifted and lowered by the subject, having the subject move the upper trunk in one direction by exerting said muscles to apply a force to the movement arm to pivot the movement arm in one direction to lift said resistance weight and then move the upper trunk in an opposite direction, and repeating said steps until said muscles fatigue and are no longer capable of pivoting the movement arm in said one direction;

wherein prior and subsequent to said method the method of said subject are subjected to a static strength test and the results of said static strength test are compared to determine the effect of said method on the static strength of said muscles;

wherein the subject applies forces to the movement arm smoothly and gradually avoiding impact and sudden or jerky movements and wherein the stroke of said resistance weight is limited to a distance on the order of three inches in order to substantially reduce kinetic energy of the weight.

5. A method of testing muscles such as lumbar or abdominal muscles of the lower trunk of the human body comprising the steps of seating a subject body on a seat with the pelvis restrained against movement to isolate movement of said muscles from the pelvis, connecting to a movement arm a resistance weight or known forces less than the maximum static strength of said muscles to be lifted and lowered by the subject, having the subject move the upper trunk in one direction by exerting said muscles to apply a force to the movement arm to pivot the movement arm in one direction to lift said resistance weight and then move the upper trunk in an opposite direction, and repeating said steps until said muscles fatigue and are no longer capable of pivoting the movement arm in said one direction and wherein there is further included the step of counter balancing the mass of the upper trunk of the subject's body relative to said axis by means of a counterweight connected to the movement arm.

6. The method defined in claim 5 wherein prior and subsequent to said method the muscles of said subject are subjected to a static strength test and the results of said static strength test are compared to determine the effect of said method on the static strength of said muscles.

7. The method defined in claim 5 wherein the subject applies forces to the movement arm smoothly and gradually avoiding impact and sudden or jerky movements.

8. The method defined in claim 5 wherein the resistance weight is at least thirty percent less than the maximum static strength of said muscles.

9. The method defined in claim 5 wherein said resistance weight is freely moveable only in respect to application of force by said muscles.

* * * * *

UNITED STATES PATENT AND TRADEMARK OFFICE

CERTIFICATE OF CORRECTION

PATENT NO. : 5,092,590

DATED : March 3, 1992

INVENTOR(S) : ARTHUR A. JONES

It is certified that error appears in the above-identified patent and that said Letters Patent is hereby corrected as shown below:

On the title page, item [60]: under "RELATED U.S. APPLICATION DATA", code paragraph (60), line 5, delete "which is a continuation-in-part of" and insert ----and----.

Line 4, "Jan. 11, 1987" should read --June 11, 1987.--

Signed and Sealed this

Twentieth Day of June, 1995

Bruce Lehman

*Attest:*

BRUCE LEHMAN

*Attesting Officer*

*Commissioner of Patents and Trademarks*